US011020779B1

(12) United States Patent
Chen

(10) Patent No.: US 11,020,779 B1
(45) Date of Patent: Jun. 1, 2021

(54) BOTTLE CLEANING SYSTEM AND METHOD OF USE

(71) Applicant: Heidi Chen, Frisco, TX (US)

(72) Inventor: Heidi Chen, Frisco, TX (US)

( * ) Notice: Subject to any disclaimer, the term of this patent is extended or adjusted under 35 U.S.C. 154(b) by 122 days.

(21) Appl. No.: 16/524,474

(22) Filed: Jul. 29, 2019

(51) Int. Cl.

| | |
|---|---|
| ***B08B 9/36*** | (2006.01) |
| ***B08B 9/08*** | (2006.01) |
| ***B08B 9/087*** | (2006.01) |
| ***A47L 15/00*** | (2006.01) |

(52) U.S. Cl.
CPC ..... *B08B 9/36* (2013.01); *A47L 15/0068* (2013.01); *B08B 9/087* (2013.01); *B08B 9/0808* (2013.01); *A46B 2200/3006* (2013.01); *B08B 9/0821* (2013.01); *B08B 2209/08* (2013.01)

(58) Field of Classification Search
CPC ..... B08B 9/0808; B08B 9/087; B08B 9/20; B08B 9/36; B08B 9/28; A47L 15/0065; A47L 15/0068; A46B 2200/3006
USPC ..... 15/59, 65–67, 70–71, 75–76, 101, 164
See application file for complete search history.

(56) References Cited

U.S. PATENT DOCUMENTS 1,436,361 A * 11/1922 Seeley ..... A47L 15/0068 15/75
1,921,509 A * 8/1933 De Forest ..... A47L 15/0068 15/76
2,671,235 A * 3/1954 Gochoel ..... A47L 15/0068 15/76

FOREIGN PATENT DOCUMENTS

DE 422973 C * 12/1925 ..... A47L 15/0068
GB 2074550 A * 11/1981 ..... A47L 15/0068

OTHER PUBLICATIONS

Computer generated English translation of DE 422973 C, Kirchhoff, published Dec. 1925. (Year: 1925).*

* cited by examiner

*Primary Examiner* — Laura C Guidotti
(74) *Attorney, Agent, or Firm* — Richard Eldredge; Leavitt Eldredge Law Firm

(57) ABSTRACT

A bottle cleaning system includes a bowl; and a brush attachment attached to the bottom surface of the bowl, and having an elongated tube attached to a rod engaged with a pressure seat, the pressure seat attached to a first valve; bristles extending from the elongated tube; a housing extending around the rod and positioned above the pressure seat; and a connection system attached to the bottom surface of the bowl, and having a plate with a channel, the channel to align with the pressure seat; and a spring surrounding the channel and having a second valve contained therein; depressing the spring via the housing forces liquid through the channel and the elongated tube; the bristles allow for one handed cleaning of a bottle.

7 Claims, 5 Drawing Sheets

BOTTLE CLEANING SYSTEM AND METHOD OF USE

BACKGROUND

1. Field of the Invention

The present invention relates generally to bottle cleaning systems, and more specifically, to a system that allows for one handed, efficient cleaning of a bottle, thereby giving a mother the ability to use their other hand for another task, such as holding a child.

2. Description of Related Art

Bottle cleaning systems are well known in the art and are effective means to sanitize and clean bottles, such as baby bottles. For example, FIG. 1 depicts a flowchart 101 of a conventional method of cleaning a bottle. Conventionally, a mother or father will open up a bottle and use soap and water to scrub the inside of the bottle, as shown with boxes 103, 105, 107. The mother/father can then rinse and dry the bottle, as shown with box 109.

One of the problems commonly associated with method 101 is the requirement of two hands. Typically washing bottles requires the user to use two hands to really clean and sanitize the inside of a bottle, which prevents the user from performing any other tasks, such as also holding a child.

Accordingly, although great strides have been made in the area of bottle cleaning systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
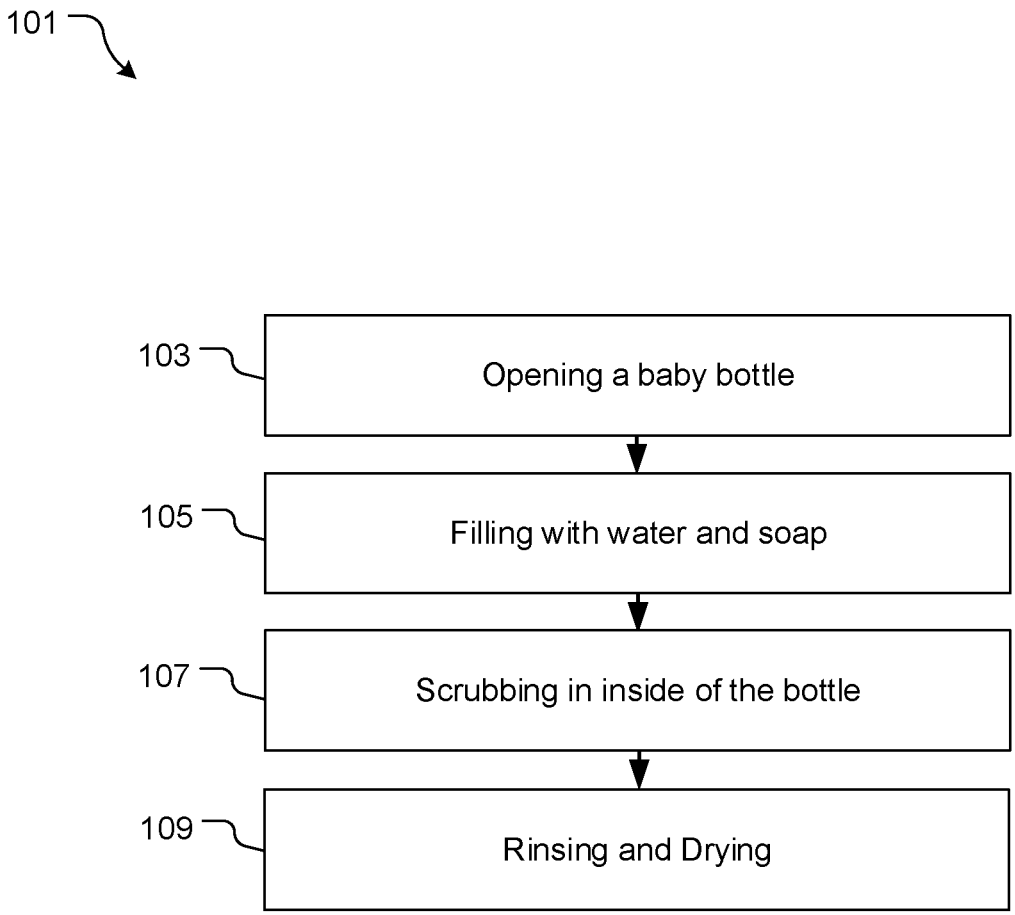
FIG. 1 (Prior Art)
FIG. 1 is a flowchart of common method of cleaning a bottle.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional bottle cleaning systems. Specifically, the present invention provides for a bottle cleaning system that can easily be used with one hand to effectively clean a bottle, thereby freeing up the user's second hand for other tasks. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
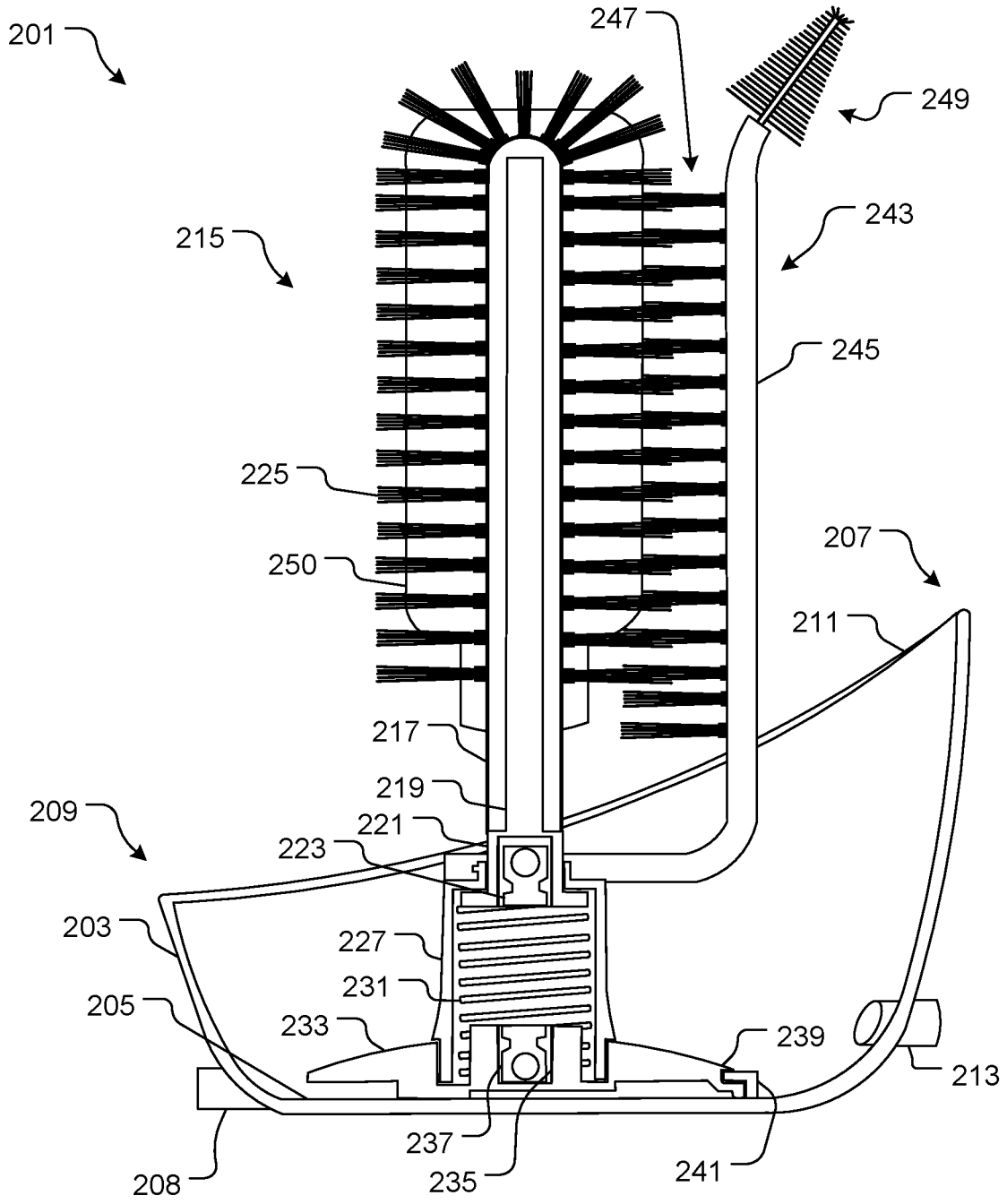
FIG. 2 is a front view of a bottle cleaning system in accordance with a preferred embodiment of the present invention.
Figure 3:
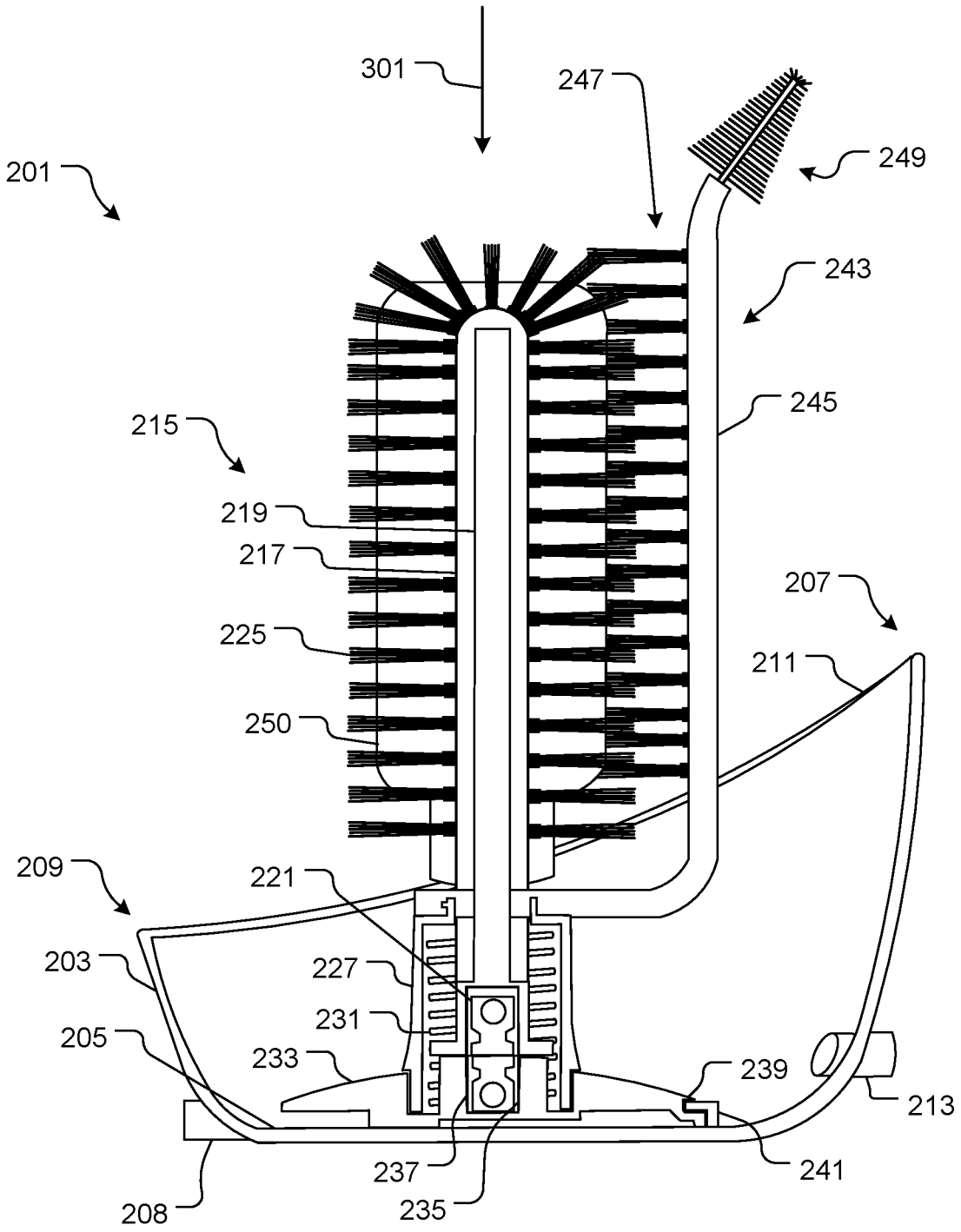
FIG. 3 is a front view of a bottle cleaning system of FIG. 2 with the brush attachment depressed.

Referring now to the drawings wherein like reference characters identify corresponding or similar elements throughout the several views, FIGS. 2 and 3 depict front views of a bottle cleaning system 201 in accordance with a preferred embodiment of the present application. It will be appreciated that system 201 overcomes one or more of the above-listed problems commonly associated with conventional bottle cleaning methods.

In the contemplated embodiment, system 201 includes a bowl 203 having a bottom surface 205 and the bowl 203 extending from a first end 207 to a second end 209. In some embodiments, a leg 208 is included such that when the bowl is tilted, the leg raises the back end such that drainage is more efficient. In the preferred embodiment, the bowl 203 has a top surface 211 that tapers from the second end 209 to the first end 207. In some embodiments, the bowl further includes a drain 213 configured to provide an opening from the interior of the body, such that the user can drain liquid from the inside of the bowl.

System 201 further includes a brush attachment 215 having an elongated tube 217 slidingly engaged with a rod 219, the rod 219 engaged with a pressure seat 221, the pressure seat 221 further attached to a first valve 223. In the preferred embodiment, the brush attachment 215 further includes a plurality of bristles 225 extending from the elongated tube.

System 201 further includes a housing 227 extending around the rod 219 and positioned to engage with the pressure seat 221. In the preferred embodiment, the housing 227 is positioned around a spring 231 and sits within a disk 233 positioned at the bottom of the bowl. As shown, the disk 233 includes a channel 235 holding a second valve 237 and can include a lip 239 configured to engage with a clip 241 extending from the bottom surface of the bowl.

In the preferred embodiment, system 201 further includes a second brush 243 having an elongated rod 245 with a second set of bristles 247. In some embodiments, the second brush 243 further includes a top tapered brushing element 249. As shown, the second brush is attached to the tube 217.

It should be appreciated that one of the unique features believed characteristic of the present application is the configuration of elements that allows for a user to clean a bottle 250 with one hand. The user can invert the bottle 250 and place the bottle over the top of the bristles, wherein the user can push the bottle down, such that liquid from the bowl is pushed through the tube to clean the brush.

Figure 4:
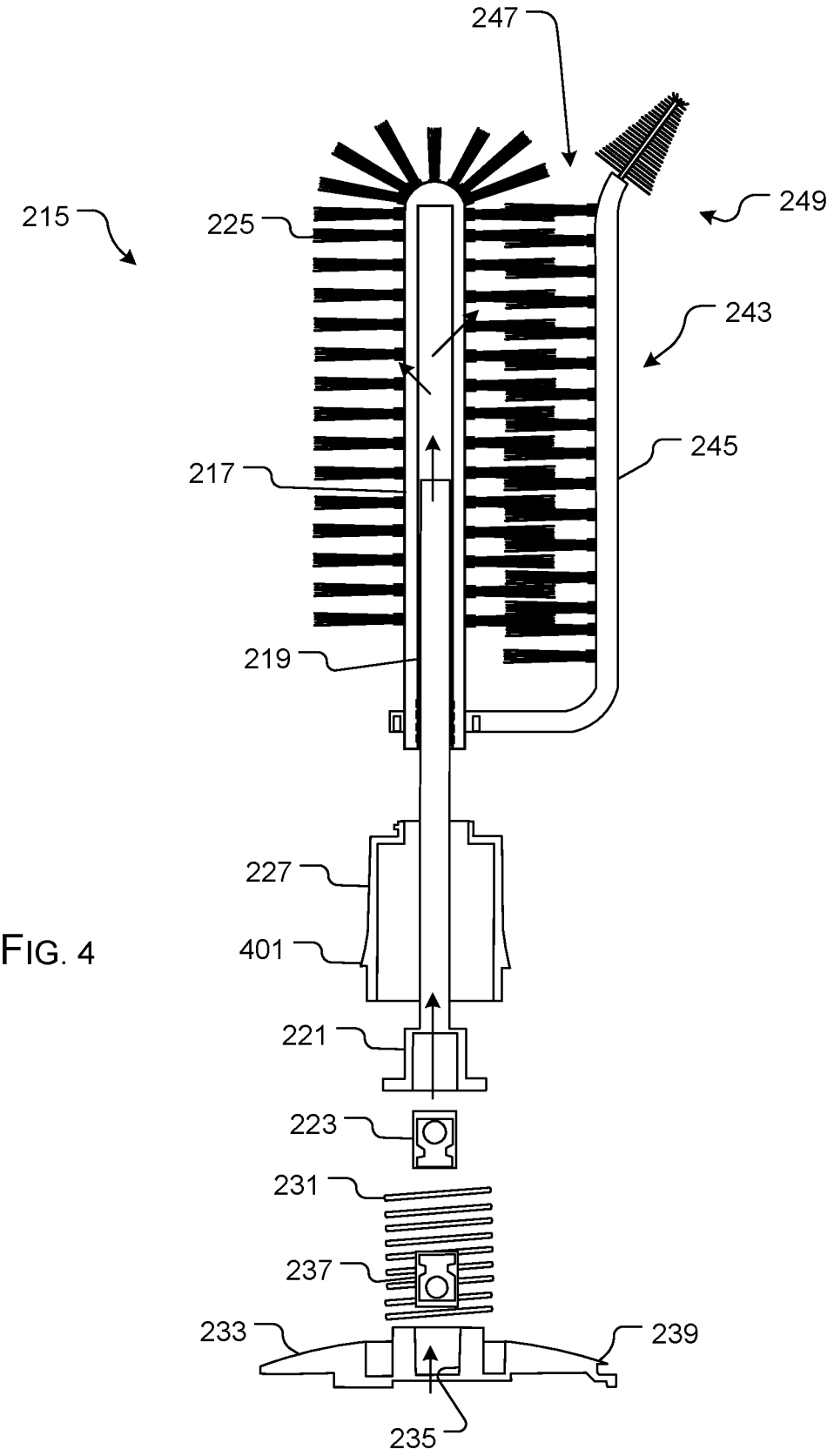
FIG. 4 is a disassembled view of the brush attachment of FIG. 2.

In FIG. 3, the depressing 301 of the brush attachment 215 is shown for clarity. In FIG. 4, a disassembled view further depicts the features. As shown, the plate 233 and channel 235 receive the valve 237 and spring 231 therearound. The rod 219 attached to the pressure seat 221 extends through housing 227, such that when the rod 219 slides through the housing, the pressure seat 221 will engage with a top of the housing. The housing 227 can further include a lip 401 to engage with a top of the plate 233. Further shown in FIG. 4, is the flow (shown with the arrows) of liquid through the system. The liquid will be placed in the bowl, as the user depresses the brush attachment, water is pushed from the bowl, through the channel 235, through the pressure seat 221, through the rod 219, and through the tube 217 and out through the bristles, thereby cleaning the inside of the bottle.

The system can include additional features, such as a collapsible bowl, additional brushes, different sizes of brushes, and the like.

Figure 5:
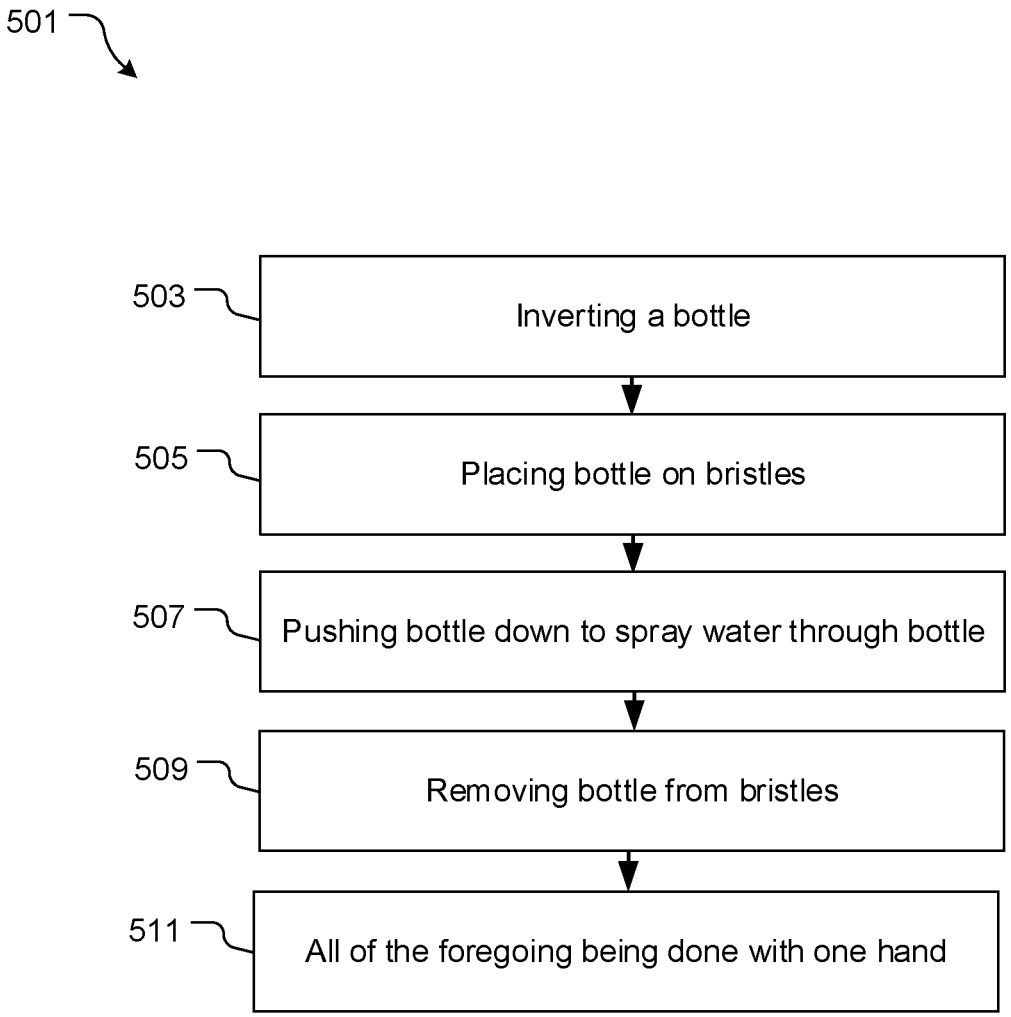
FIG. 5 is a flowchart of the method of use of the system of FIG. 2.

In FIG. 5, a flowchart 501 depicts the method of use of system 201. During use, the bottle is inverted and placed over the top of the brush, as shown with boxes 503, 505. The bottle is pushed down, thereby forcing water through the system to the inside of the bottle, as shown with box 507. After the bottle is cleaned to the desires of the user, the user will remove the bottle, as shown with box 509. It should be appreciated that the entire process can be completed with one hand, thereby leaving the user's second hand free for holding a child or the like, as shown with box 511.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A bottle cleaning system, comprising:

a bowl having a bottom surface and extending from a first side to a second side; and a brush attachment attached to the bottom surface of the bowl, the brush attachment having:

an elongated tube attached to a rod engaged with a pressure seat, the pressure seat further attached to a first valve;

a plurality of bristles extending from the elongated tube;

a housing extending around the rod and engaged with the pressure seat; and a connection system attached to the bottom surface of the bowl, the connection system having a plate with a channel, the channel configured to align with the pressure seat; and a spring surrounding the channel and having a second valve contained therein;

wherein depressing the spring via the housing forces liquid through the channel and the elongated tube;

wherein the bristles allow for one handed cleaning of a bottle.

2. The system of claim 1, wherein the bowl has a tapered top surface extending from the first side to the second side.

3. The system of claim 1, wherein the bowl further includes a drain configured to open to an interior of the bowl.

4. The system of claim 1, wherein the connection system further comprises:

a clip extending from the bottom surface of the bowl; and the plate having a lip configured to engage with the clip.

5. The system of claim 1, further comprising:

a second brush having a second elongated rod attached to the elongated tube and having a second set of bristles extending therefrom, wherein the second set of bristles engage with the plurality of bristles.

6. The system of claim 5, wherein the second brush further comprises:

a top tapered brushing element.

7. A method of cleaning a bottle, the method comprising:

providing the system of claim 1;

inverting a bottle over the top of the plurality of bristles;

pressing down on the bottle, such that liquid travels from the bowl, through the channel, through the elongated tube, and into the bottle; and removing the bottle.

* * * * *